US010458625B2

(12) United States Patent
Wholehan

(10) Patent No.: US 10,458,625 B2
(45) Date of Patent: Oct. 29, 2019

(54) LIGHT DIFFUSER SUPPORT

(71) Applicant: Brian Wholehan, Toledo, OH (US)

(72) Inventor: Brian Wholehan, Toledo, OH (US)

( * ) Notice: Subject to any disclaimer, the term of this patent is extended or adjusted under 35 U.S.C. 154(b) by 0 days.

(21) Appl. No.: 15/571,286

(22) PCT Filed: Oct. 5, 2017

(86) PCT No.: PCT/US2017/055322

§ 371 (c)(1),
(2) Date: Nov. 2, 2017

(87) PCT Pub. No.: WO2018/075255

PCT Pub. Date: Apr. 26, 2018

(65) Prior Publication Data

US 2019/0234589 A1 Aug. 1, 2019

Related U.S. Application Data

(60) Provisional application No. 62/408,906, filed on Oct. 17, 2016.

(51) Int. Cl.
*F21V 17/06* (2006.01)
*F21V 3/02* (2006.01)

(52) U.S. Cl.
CPC ..... *F21V 17/06* (2013.01); *F21V 3/02* (2013.01)

(58) Field of Classification Search
CPC ..... F21V 17/06; F21V 3/02
See application file for complete search history.

(56) References Cited

U.S. PATENT DOCUMENTS

| | | | | |
|---|---|---|---|---|
| 1,382,145 A * | 6/1921 | Tomlinson | ..... | F21V 17/00 362/307 |
| 1,384,578 A * | 7/1921 | Tomlinson | ..... | F21V 17/06 362/306 |
| 1,759,093 A | 5/1930 | Clawson | | |
| 1,764,393 A | 6/1930 | Doane | | |
| 8,235,557 B2 | 8/2012 | Brown | | |

FOREIGN PATENT DOCUMENTS

| | | |
|---|---|---|
| DE | 1796795 | 10/1959 |
| DE | 202012008925 U1 | 10/2012 |

OTHER PUBLICATIONS

International Search Report for corresponding application PCT/US2017/055322; dated Dec. 28, 2017.
DE1796795 Machine Translation.

* cited by examiner

*Primary Examiner* — Thomas M Sember
(74) *Attorney, Agent, or Firm* — Black, McCuskey, Souers & Arbaugh, LPA

(57) ABSTRACT

A light diffuser assembly for a light bulb fixture can include a retaining member and a diffuser member. The retaining member can include a collar and a plurality of arms. The collar can be configured to be pushed over a socket of the light bulb fixture. Each of the plurality of arms can extend away from the collar and from a central axis to a respective distal end and include a tab at the respective distal end. The diffuser member can include an annular lip that is received by each of the plurality of tabs. The retaining member can also include first and second grips. The first and second grips are graspable and moveable closer together to deform the collar and tighten the collar about the socket of the light bulb fixture.

5 Claims, 10 Drawing Sheets

LIGHT DIFFUSER SUPPORT

CROSS-REFERENCE TO RELATED APPLICATIONS

This application claims the benefit of International Patent Application Serial No. PCT/US17/55322 for a LIGHT DIFFUSER SUPPORT, filed on 17 Oct. 2017, which claims benefit to U.S. Provisional Patent Application Ser. No. 62/408,906 for a LIGHT SHADE SUPPORT, filed on 17 Oct. 2016, which is hereby incorporated by reference in its entirety.

BACKGROUND

1. Field

The present disclosure relates to a structure for supporting a shade on a light emitting structure.

2. Description of Related Prior Art

DE1796795 discloses an apparatus for securing a lamp shade.

The background description provided herein is for the purpose of generally presenting the context of the disclosure. Work of the presently named inventor, to the extent it is described in this background section, as well as aspects of the description that may not otherwise qualify as prior art at the time of filing, are neither expressly nor impliedly admitted as prior art against the present disclosure.

SUMMARY

A light diffuser assembly for a light bulb fixture can include a retaining member and a diffuser member. The retaining member can include a collar and a plurality of arms. The collar can be substantially centered on a central axis. The collar can extend about an arcuate path less than three hundred and sixty degrees about the central axis between opposite first and second ends and thereby define a collar gap. The collar can be configured to be pushed over a socket of the light bulb fixture. Each of the plurality of arms can extend away from the collar and the central axis to a respective distal end. Each of the plurality of arms includes a tab at the respective distal end. Each of the plurality of tabs extends back towards the central axis. The diffuser member can include an annular lip that is received by each of the plurality of tabs whereby the diffuser member is suspended on the base of the light bulb fixture by the retaining member. The retaining member can also include first and second grips. One of the first and second grips can be respectively disposed at one of the first end and the second end of the collar. Each of the first grip and the second grip can extend away from the arcuate path and further away from the central axis. Each of the plurality of arms can extend away from the central axis further than the first and second grips. The first and second grips are graspable and moveable closer together to deform the collar and tighten the collar about the socket of the light bulb fixture.

BRIEF DESCRIPTION OF THE DRAWINGS

The detailed description set forth below references the following drawings.

DETAILED DESCRIPTION

Figure 1:
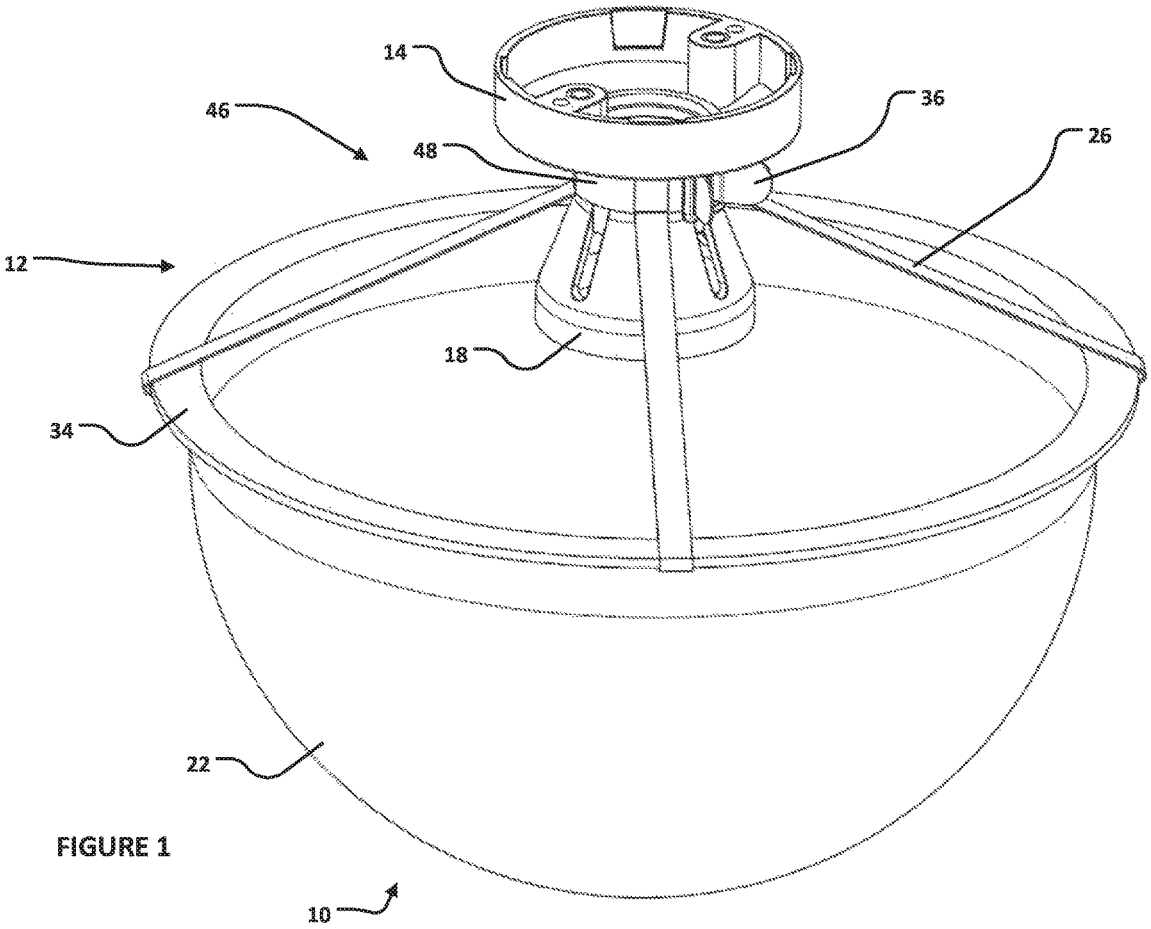
FIG. 1 is a perspective view of a first exemplary embodiment of the present disclosure in operation.
Figure 2:
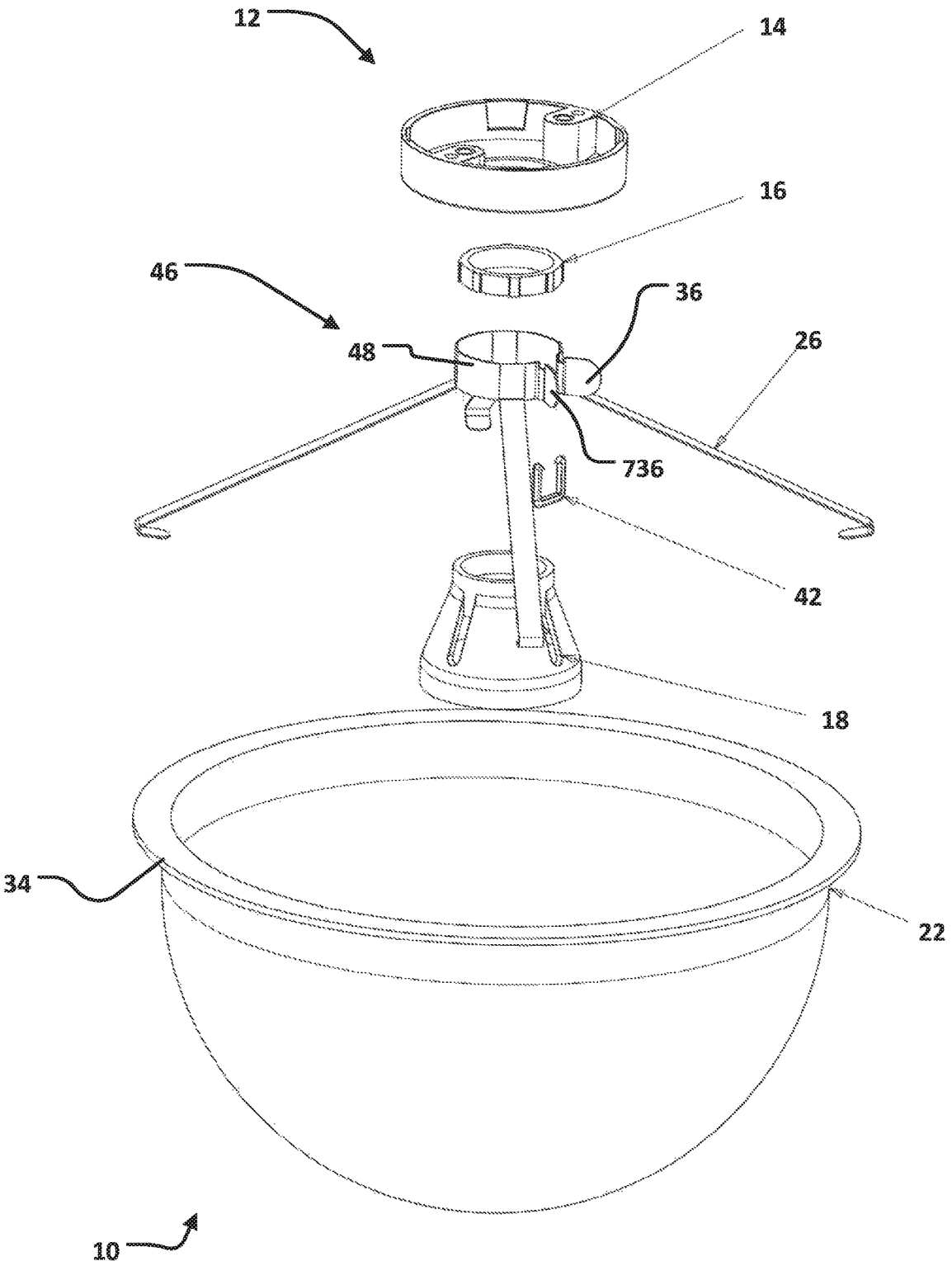
FIG. 2 is an exploded view of the first exemplary embodiment of the present disclosure in operation.
Figure 3:
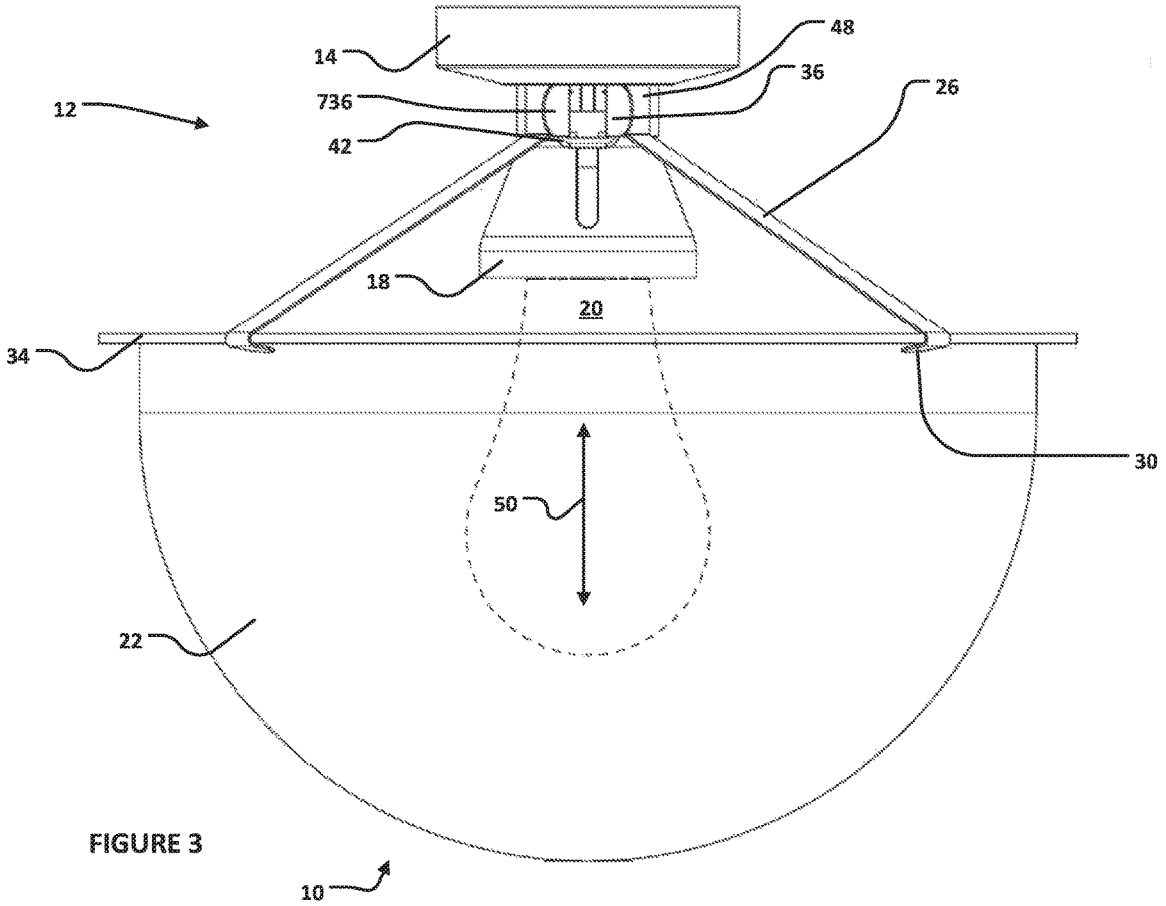
FIG. 3 is a side view of the first exemplary embodiment of the present disclosure in operation.

A plurality of different embodiments of the present disclosure is shown in the Figures of the application. Similar features are shown in the various embodiments of the present disclosure. Similar features across different embodiments have been numbered with a common reference numeral and have been differentiated by an alphabetic suffix. Similar features in a particular embodiment have been numbered with a common two-digit, base reference numeral and have been differentiated by a different leading numeral. Also, to enhance consistency, the structures in any particular drawing share the same alphabetic suffix even if a particular feature is shown in less than all embodiments. Similar features are structured similarly, operate similarly, and/or have the same function unless otherwise indicated by the drawings or this specification. Furthermore, particular features of one embodiment can replace corresponding features in another embodiment or can supplement other embodiments unless otherwise indicated by the drawings or this specification.

FIGS. 1-4 and 9 are illustrations of a first exemplary light diffuser assembly 10. The light diffuser assembly 10 can be formed from a metal or another material and can selectively engageable with a light bulb fixture 12. The light bulb fixture 12 can include a junction box mounting bracket 14, a nut 16, and a socket 18. The junction box mounting bracket 14 can be mounted to a junction box (not shown) mounting in a wall or ceiling. The junction box mounting bracket 14 can be mounted to the junction box with fasteners and wires can pass through the junction box mounting bracket 14. The nut 16 can releasably interconnect the junction box mounting bracket 14 and the socket 18. The socket 18 can define the electrical contacts for communicating electricity between the junction box and a light bulb 20 (shown in phantom).

Figure 4:
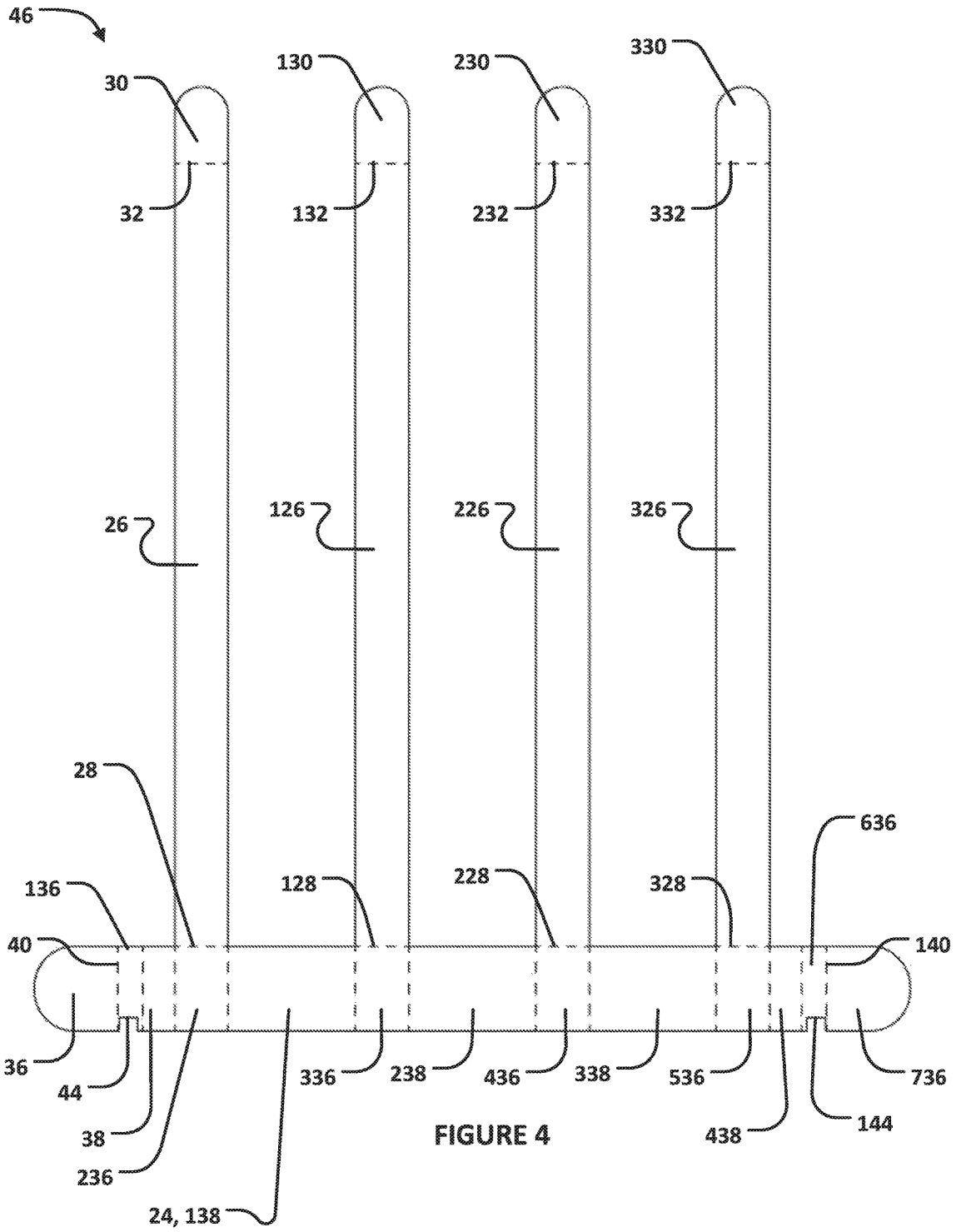
FIG. 4 is a planar view of the first exemplary embodiment of the present disclosure in operation prior to being bent for operation.
Figure 5:
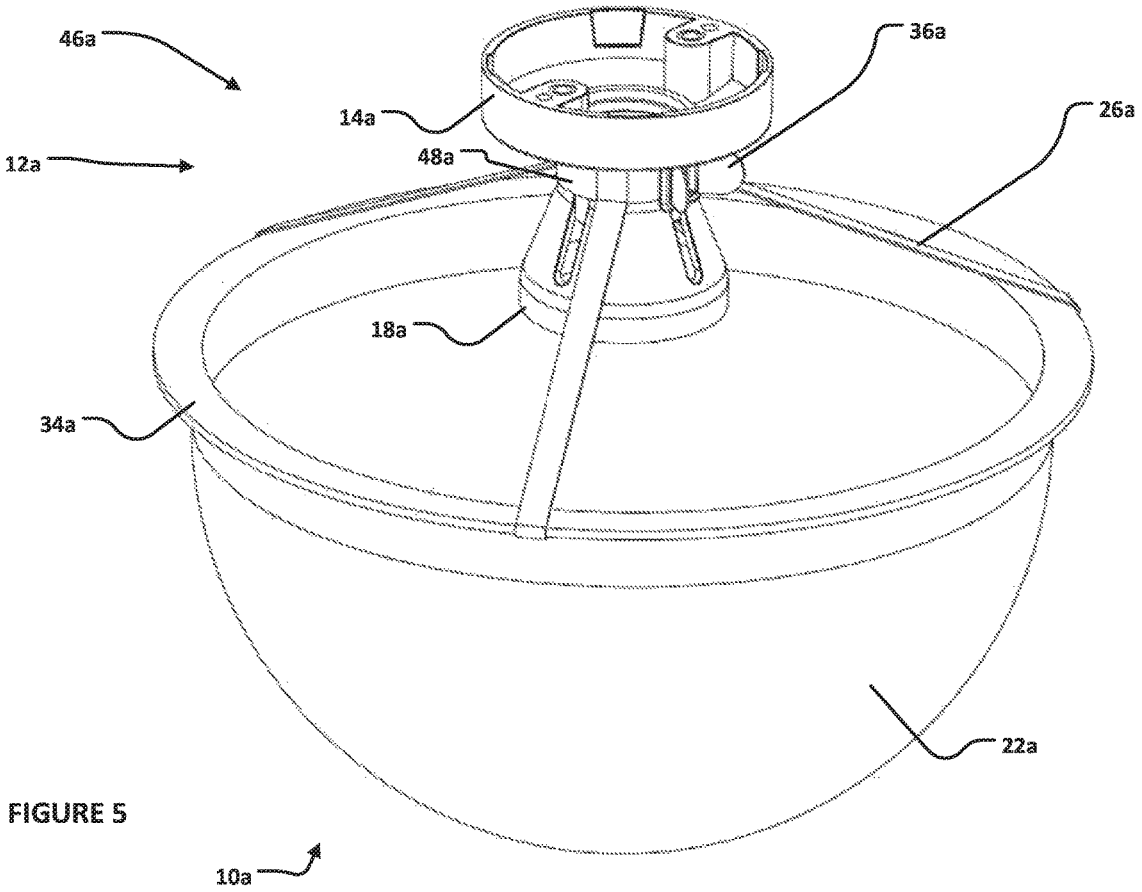
FIG. 5 is a perspective view of a second exemplary embodiment of the present disclosure in operation.
Figure 6:
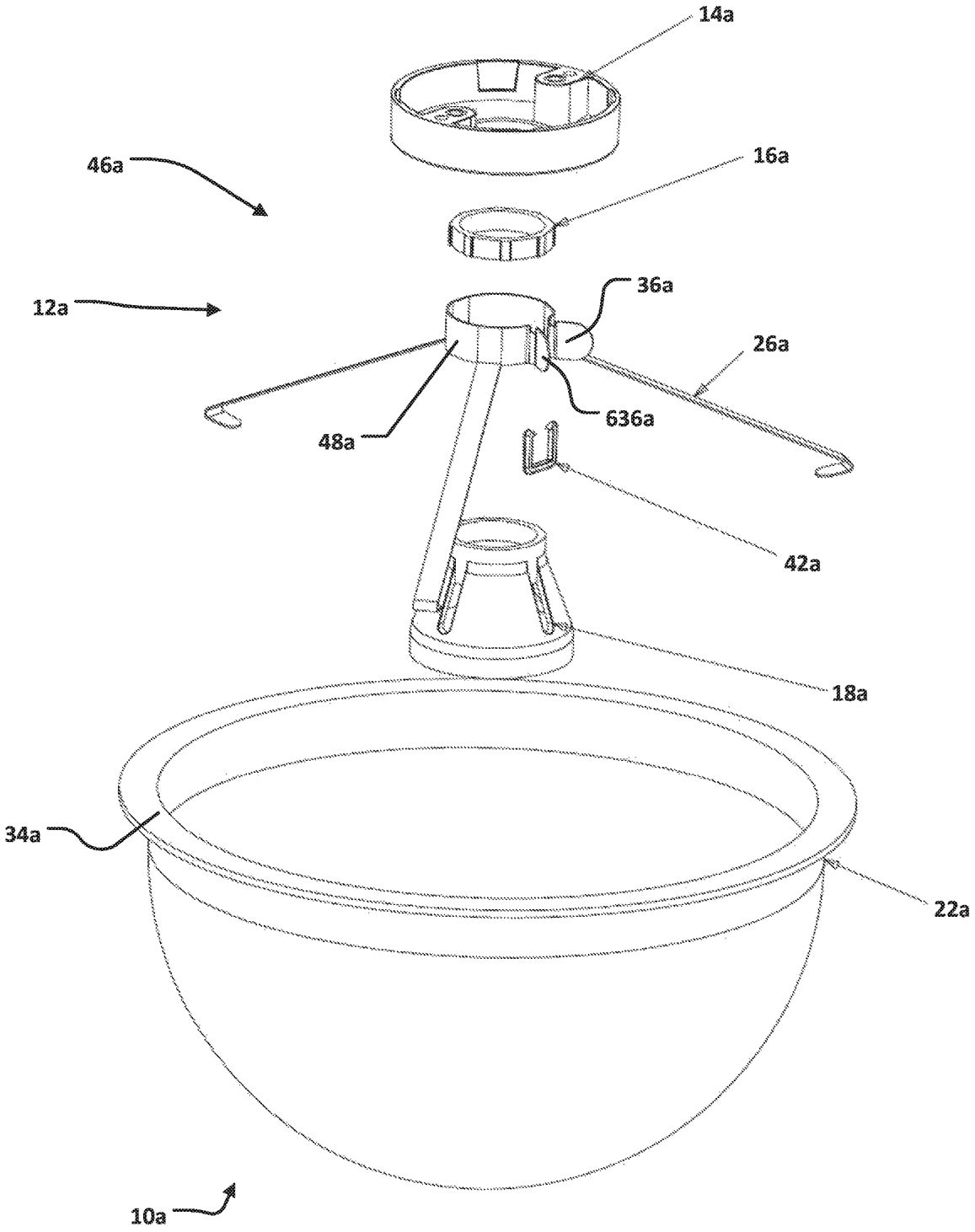
FIG. 6 is an exploded view of the second exemplary embodiment of the present disclosure in operation.
Figure 7:
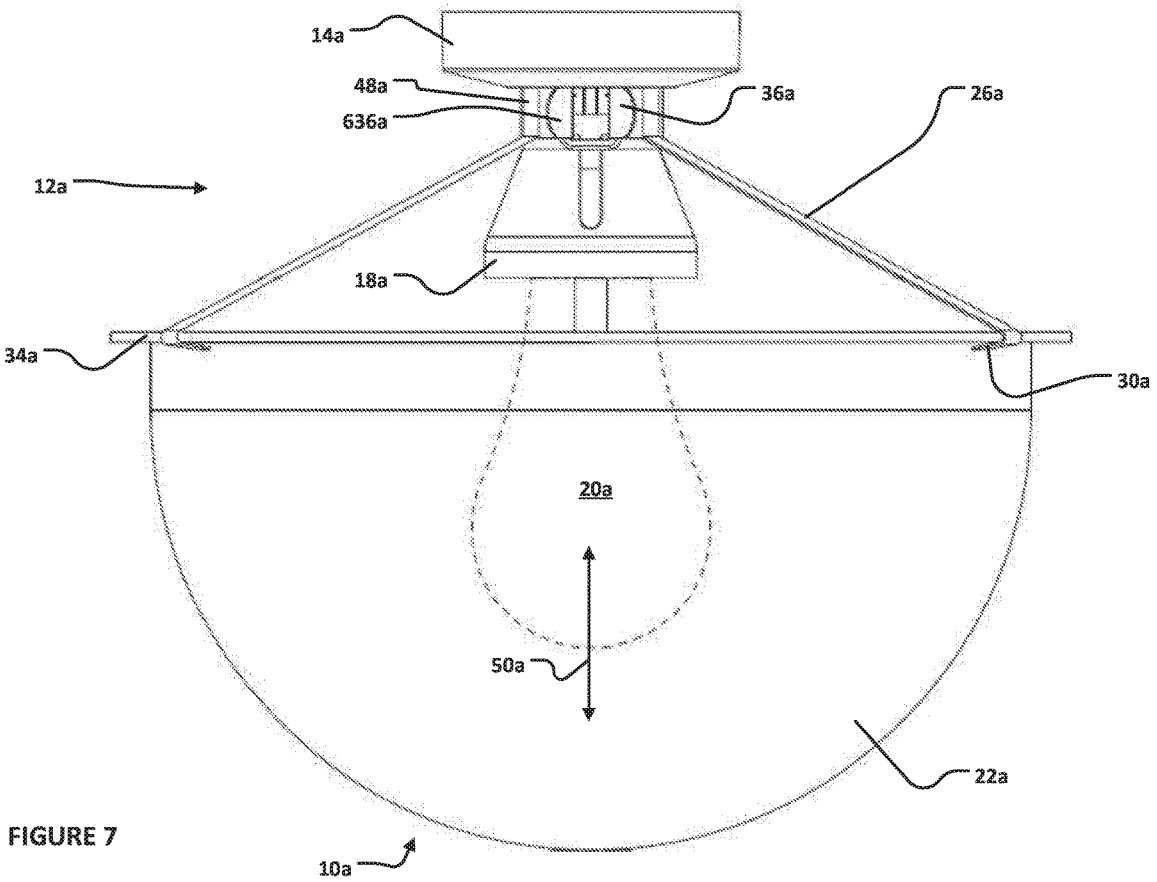
FIG. 7 is a side view of the second exemplary embodiment of the present disclosure in operation.
Figure 8:
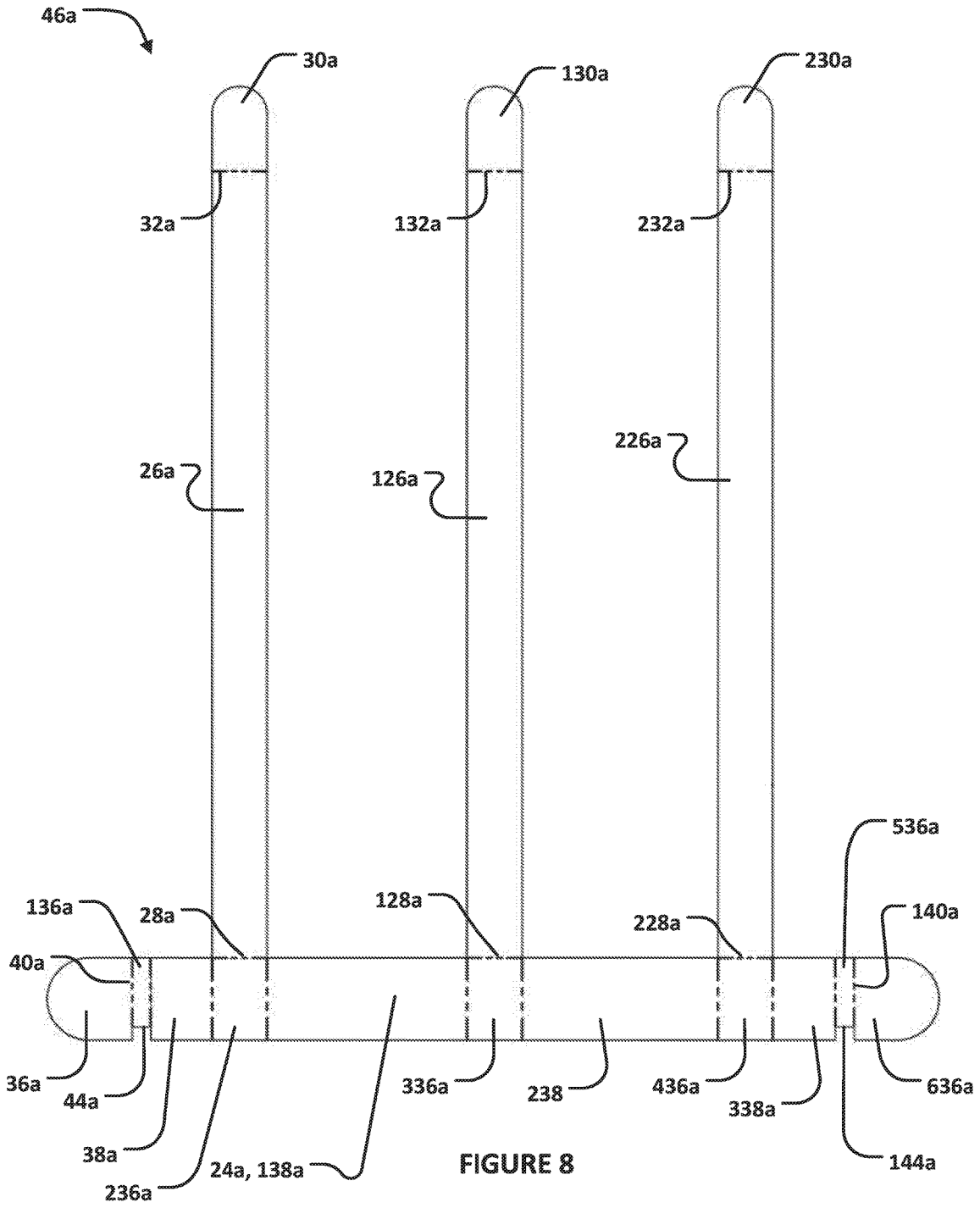
FIG. 8 is a planar view of the second exemplary embodiment of the present disclosure in operation prior to being bent for operation.
Figure 9:
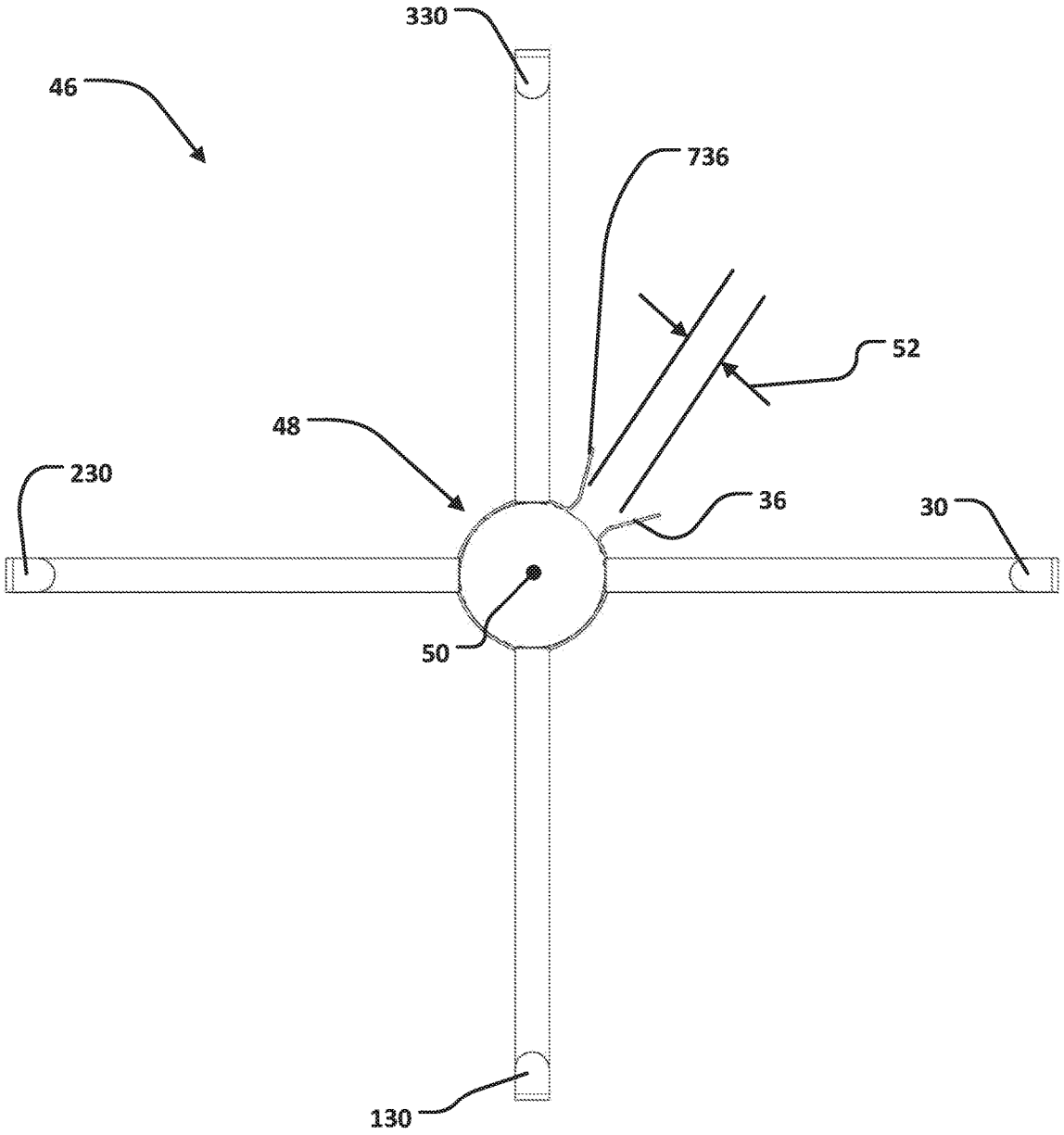
FIG. 9 is bottom view looking up of a retaining member according to the first exemplary embodiment of the present disclosure.
Figure 10:
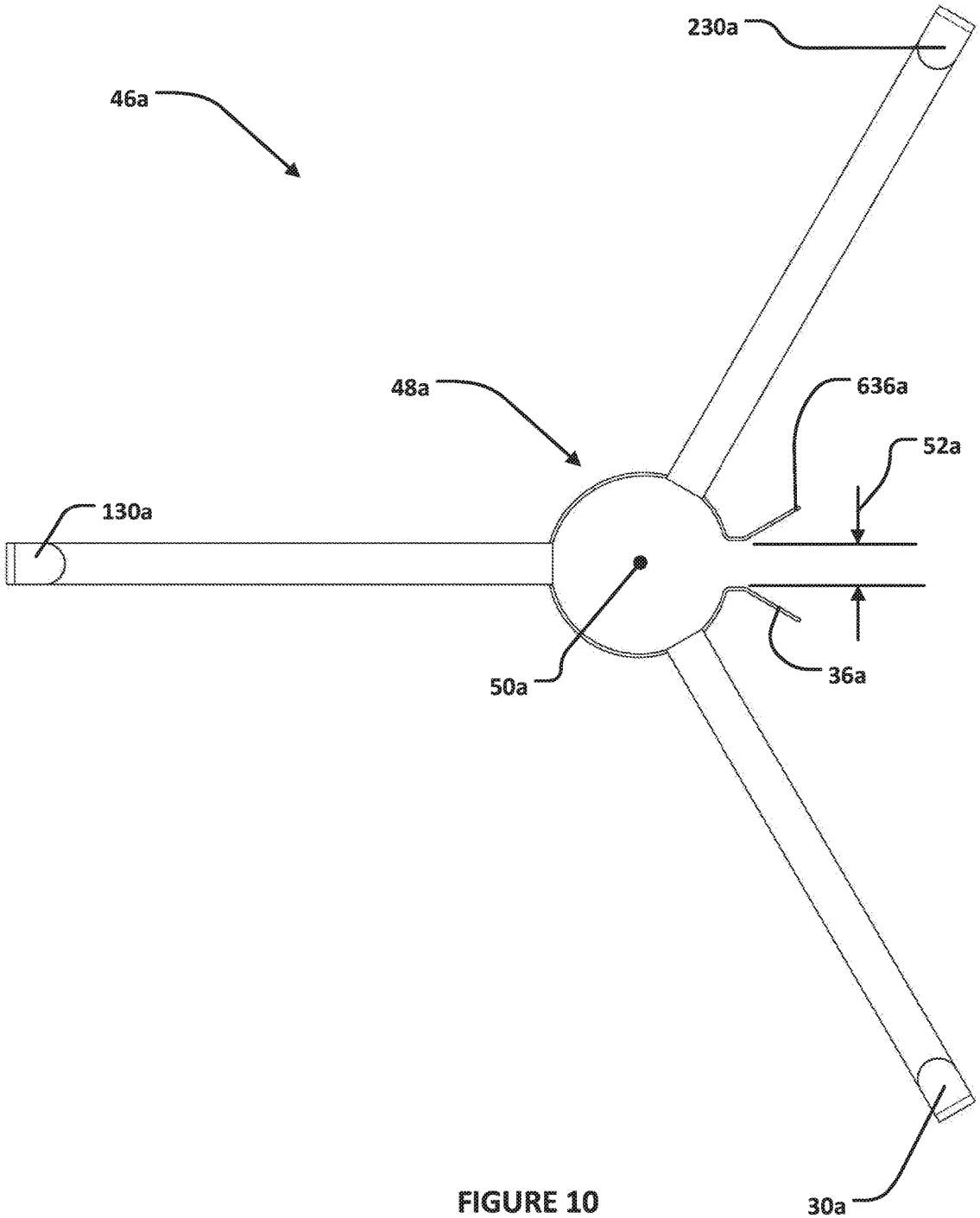
FIG. 10 is bottom view looking up of a retaining member according to the second exemplary embodiment of the present disclosure.

The exemplary light diffuser assembly 10 can include a diffuser member 22 and a retaining member 46. The retaining member 46 can be bent from the configuration shown in FIG. 4 to the configuration shown in FIGS. 1-3 to mount the diffuser member 22 on the socket 18. The retaining member 46 includes a base 24 and arms 26, 126, 226, 326. The dashed lines in FIG. 4 represent bending planes. For example, the arms 26, 126, 226, 326 can be bent about lines 28, 128, 228, 328, respectively, out of the plane of the base 24. Distal ends or tips 30, 130, 230, 330 of the arms 26, 126, 226, 326 can be bent about lines 32, 132, 232, 332, respectively, to form tabs for engaging a lip 34 of the diffuser member 22.

The base 24 can be bent to form a collar 48 corresponding to the generally circular profile of the socket 18. The portions of the base 24 referenced at 36, 136, 236, 336, 436, 536, 636, and 736 can be left flat. The portions of the base 24 referenced at 38, 138, 238, 338, and 438 can be bent to be arcuate. The adjacent flat portions 36 and 136 can be bent with respect to one another about line 40 to be in transverse planes. The adjacent flat portions 636 and 736 can be bent with respect to one another about line 140 to be in transverse planes.

The exemplary collar 48 is substantially centered on a central axis 50. The exemplary collar 48 extends about an arcuate path less than three hundred and sixty degrees about the central axis 50 between opposite first and second ends. The arcuate path is most easily perceived in FIG. 9. The portions 38 and 438 can define the first and second ends. The collar 48 can thus include an exemplary collar gap 52. The exemplary collar 48 is configured to be pushed over a socket 18 of the light bulb fixture 12, elastically deformed during this process. Each of the plurality of exemplary arms 26, 126, 226, 326 extends away from the exemplary collar 48 and the central axis 50 to the respective distal ends 30, 130, 230, 330. Each of the plurality of arms 26, 126, 226, 326 includes a tab in the form of the respective distal ends 30, 130, 230, 330. Each of the plurality of tabs 30, 130, 230, 330 extends back towards the central axis 50.

The light diffuser assembly 10 can also include a clip 42. Distal ends of the clip 42 can be received in notches 44, 144 of the base 24 when the light diffuser assembly 10 has been bent to encircle the socket 18. The portions 36 and 736 of the base 24 can be brought together and the clip 42 can be raised to so that portions 136 and 636 are between the arms of the clip 42. The clip 42 can be raised until the distal ends are received in the notches 44, 144. The clip thus prevents the retaining member 46 from being released relative to the socket 18.

The clip 42 is optional. The retaining member 46 includes first and second grips in the form of portions 36 and 736. The exemplary collar 48, the plurality of arms 26, 126, 226, 326, and the first and second grips 36, 736 are metallic and integrally-formed with respect to one another. "Integrally-formed" refers to the fact that in the exemplary embodiment the exemplary collar 48, the plurality of arms 26, 126, 226, 326, and the first and second grips 36, 736 are formed together rather than being formed separately and then subsequently joined. The term defines a structural feature since structures that are integrally-formed are structurally different than structures that are comprised of subcomponents formed separately and then subsequently joined. "Integral" means consisting or composed of parts that together constitute a whole and thus encompasses structures of more than one part wherein the parts are either integrally-formed or formed separately and then subsequently joined.

The first and second grips 36 and 736 are respectively disposed at one of the first end and the second end of the collar 48 (portions 38 and 438). Each of the first grip 36 and the second grip 736 extend away from the arcuate path and further away from the central axis 50. The plurality of arms 26, 126, 226, 326 extend away from the central axis 50 further than the first and second grips 36, 736. The first and second grips 36, 736 are graspable and moveable closer together to deform the collar 48 and tighten the collar 48 about the socket 18 of the light bulb fixture 12. The collar 48, thus deformed, can suffice to affix the retaining member 46 to the socket 18 and therefore sufficient to affix the diffuser member 22 to the socket 18.

In one or more embodiments of the present disclosure, the light diffuser assembly 10 could have a metal frame in the shape shown in FIG. 4 and, further, be coated in a heat resistant material such as silicone. This would allow such an embodiment to dampen any vibrations. Also, embodiments of the present disclosure could be formed in various colors.

FIGS. 5-8 and 10 are illustrations of a second exemplary light diffuser assembly 10*a*. The exemplary light diffuser assembly 10*a* is selectively engageable with a light bulb fixture 12*a*. The light bulb fixture 12*a* can include a junction box mounting bracket 14*a*, a nut 16*a*, and a socket 18*a*. The junction box mounting bracket 14*a* can be mounted to a junction box (not shown) mounting in a wall or ceiling. The junction box mounting bracket 14*a* can be mounted to the junction box with fasteners and wires can pass through the junction box mounting bracket 14*a*. The nut 16*a* can releasably interconnect the junction box mounting bracket 14*a* and the socket 18*a*. The socket 18*a* can define the electrical contacts for communicating electricity between the junction box and a light bulb 20*a* (shown in phantom).

The exemplary light diffuser assembly 10*a* can include a diffuser member 22*a* and a retaining member 46*a*. The retaining member 46*a* can be bent from the configuration shown in FIG. 8 to the configuration shown in FIGS. 5-7 to mount the diffuser member 22*a* on the socket 18*a*. The light diffuser assembly 10*a* includes a base 24*a* and arms 26*a*, 126*a*, 226*a*. The dashed lines in FIG. 4*a* represent bending planes. For example, the arms 26*a*, 126*a*, 226*a* can be bent about lines 28*a*, 128*a*, 228*a*, respectively, out of the plane of the base 24*a*. Distal ends or tip 30*a*, 130*a*, 230*a*, of the arms 26*a*, 126*a*, 226*a* can be bent about lines 32*a*, 132*a*, 232*a*, respectively, to form tabs for engaging a lip 34*a* of the diffuser member 22*a*.

The base 24*a* can be bent to surround the generally circular profile of the socket 18*a*. The portions of the base 24*a* referenced at 36*a*, 136*a*, 236*a*, 336*a*, 436*a*, 536*a*, and 636*a* can be left flat. The portions of the base 24*a* referenced at 38*a*, 138*a*, 238*a*, and 338*a* can be bent to be arcuate. The adjacent flat portions 36*a* and 136*a* can be bent with respect to one another about line 40*a* to be in transverse planes. The adjacent flat portions 536*a* and 636*a* can be bent with respect to one another about line 140*a* to be in transverse planes.

The exemplary collar 48*a* is substantially centered on a central axis 50*a*. The exemplary collar 48*a* extends about an arcuate path less than three hundred and sixty degrees about the central axis 50*a* between opposite first and second ends. The arcuate path is most easily perceived in FIG. 10*a*. The portions 38*a* and 338*a* can define the first and second ends. The collar 48*a* can thus include an exemplary collar gap 52*a*. The exemplary collar 48*a* is configured to be pushed over a socket 18*a* of the light bulb fixture 12*a*. Each of the plurality of exemplary arms 26*a*, 126*a*, 226*a* extends away from the exemplary collar 48*a* and the central axis 50*a* to the respective distal ends 30*a*, 130*a*, 230*a*. Each of the plurality of arms 26*a*, 126*a*, 226*a* includes a tab in the form of the respective distal ends 30*a*, 130*a*, 230*a*. Each of the plurality of tabs 30*a*, 130*a*, 230*a* extends back towards the central axis 50*a*.

The light diffuser assembly 10*a* can also include a clip 42*a*. Distal ends of the clip 42*a* can be received in notches 44*a*, 144*a* of the base 24*a* when the light diffuser assembly 10*a* has been bent to encircle the socket 18*a*. The portions 36*a* and 736*a* of the base 24*a* can be brought together and the clip 42*a* can be raised to so that portions 136*a* and 636*a* are between the arms of the clip 42*a*. The clip 42*a* can be raised until the distal ends are received in the notches 44*a*, 144*a*. The clip thus prevents the light diffuser assembly 10*a* from being released relative to the socket 18*a*.

The clip 42*a* is optional. The retaining member 46*a* includes first and second grips in the form of portions 36*a* and 636*a*. The exemplary collar 48*a*, the plurality of arms 26*a*, 126*a*, 226*a*, and the first and second grips 36*a*, 636*a* are metallic and integrally-formed with respect to one another. The first and second grips 36*a* and 636*a* are respectively disposed at one of the first end and the second end of the collar 48*a* (portions 38*a* and 338*a*). Each of the first grip 36*a* and the second grip 636*a* extend away from the arcuate path and further away from the central axis 50*a*. The plurality of arms 26*a*, 126*a*, 226*a* extend away from the central axis 50*a* further than the first and second grips 36*a*, 636*a*. The first and second grips 36*a*, 636*a* are graspable and moveable closer together to deform the collar 48*a* and tighten the collar 48*a* about the socket 18*a* of the light bulb fixture 12*a*. The collar 48*a*, thus deformed, can suffice to affix the retaining member 46*a* to the socket 18*a* and therefore sufficient to affix the diffuser member 22*a* to the socket 18*a*.

While the present disclosure has been described with reference to an exemplary embodiment, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the appended claims. The right to claim elements and/or subcombinations that are disclosed herein as other present disclosures in other patent documents is hereby unconditionally reserved.

What is claimed is:

1. A light diffuser assembly for a light bulb fixture comprising:

a retaining member including a collar and a plurality of arms, wherein said collar is substantially centered on a central axis, wherein said collar extends about an arcuate path less than three hundred and sixty degrees about said central axis between opposite first and second ends and thereby defines a collar gap whereby said collar is configured to be pushed over a socket of the light bulb fixture, wherein each of said plurality of arms extends away from said collar and said central axis to a respective distal end, wherein each of said plurality of arms includes a tab at said respective distal end, and wherein each of said plurality of tabs extends back towards said central axis;

a diffuser member including an annular lip that is received by each of said plurality of tabs whereby said diffuser member is suspended on the base of the light bulb fixture by said retaining member; and wherein said retaining member further comprises first and second grips, one of said first and second grips respectively disposed at one of said first end and said second end of said collar, each of said first grip and said second grip extending away from said arcuate path and further away from said central axis, wherein each of said plurality of arms extend away from said central axis further than said first and second grips, and wherein said first and second grips are graspable and moveable closer together to deform said collar and tighten said collar about the socket of the light bulb fixture.

2. The diffuser assembly of claim 1 wherein said collar and said plurality of arms are metallic and integrally-formed with respect to one another.

3. The diffuser assembly of claim 1 wherein said collar and said plurality of arms and said first and second grips are metallic and integrally-formed with respect to one another.

4. The diffuser assembly of claim 1 further comprising:

a clip selectively engageable with said retaining member and configure to fix said first and second ends together.

5. The diffuser assembly of claim 4 wherein said clip is u-shaped and extends to first and second distal ends and wherein said retaining member defines first and second notches, said first and second distal ends received in said first and second notches when said clip fixes said first and second ends together.

* * * * *